US008408185B1

(12) United States Patent
Kiker

(10) Patent No.: US 8,408,185 B1
(45) Date of Patent: Apr. 2, 2013

(54) ENGINE FUEL ECONOMIZER

(76) Inventor: Harvey G. Kiker, Avon Park, FL (US)

( * ) Notice: Subject to any disclaimer, the term of this patent is extended or adjusted under 35 U.S.C. 154(b) by 542 days.

(21) Appl. No.: 12/626,248

(22) Filed: Nov. 25, 2009

Related U.S. Application Data

(60) Provisional application No. 61/118,167, filed on Nov. 26, 2008.

(51) Int. Cl.
*F02B 51/00* (2006.01)

(52) U.S. Cl. ..... 123/536; 123/549; 123/219; 123/392

(58) Field of Classification Search ..... 123/536, 123/549, 219, 392
See application file for complete search history.

(56) References Cited

U.S. PATENT DOCUMENTS

| | | | | |
|---|---|---|---|---|
| 5,048,501 | A | 9/1991 | Smith et al. | |
| 5,134,985 | A * | 8/1992 | Rao | 123/538 |
| 5,249,623 | A * | 10/1993 | Muller et al. | 165/156 |
| 5,918,636 | A | 7/1999 | Mitchell et al. | |
| 6,555,801 | B1 * | 4/2003 | LeMieux et al. | 219/656 |
| 6,736,119 | B1 | 5/2004 | Kiker | |
| 6,796,298 | B1 | 9/2004 | Kiker | |
| 6,971,376 | B2 * | 12/2005 | Monette et al. | 123/538 |
| 7,051,723 | B2 | 5/2006 | Kiker | |
| 7,168,406 | B2 | 1/2007 | Kiker | |
| 7,302,926 | B1 * | 12/2007 | Kiker | 123/179.25 |
| 2007/0295475 | A1 | 12/2007 | Samie et al. | |

* cited by examiner

*Primary Examiner* — Marguerite McMahon
*Assistant Examiner* — James Kim
(74) *Attorney, Agent, or Firm* — Charles J. Prescott, P.A.

(57) ABSTRACT

An engine fuel economizer device connected or connectable to establish an electrical path between an electrical system of an engine, preferably a d.c. battery and a starter motor or a charging alternator of an engine, preferably an internal combustion engine. The device, in one aspect thereof, includes a coil of conductive hollow tubing having a plurality of complete turns or loops formed therealong, is positionable over and around a section of fuel line which extends from a fuel tank to the engine. In another aspect of this disclosure, the coil device is prepositioned over and along a length of nonconductive tubing which is spliceable into the fuel line after a section of fuel line is sectioned and removed. Various additional aspects position the device in close proximity to the flow of fuel from the fuel tank to the engine.

13 Claims, 6 Drawing Sheets

ENGINE FUEL ECONOMIZER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This disclosure relates generally to means for increasing or improving the fuel economy of an internal combustion engine, more particularly to a fuel economizer device which, when installed around a section of fuel line extending from the fuel tank to the engine, will noticeably increase fuel economy.

2. Description of Prior Art

With the skyrocketing cost of crude oil and therefore gasoline and diesel fuel for powering internal combustion engines, either on a standalone basis or within a vehicle, great emphasis is being placed upon devices, methods and apparatus which will increase fuel economy of these engines. One such method and apparatus is disclosed by Samie et al. in U.S. 2007/0295475 application published Dec. 27, 2007. This pending application teaches the transfer of engine heat into the transmission fluid to decrease transmission fluid viscosity such that transmission spin losses are reduced and fuel economy is increased.

Another fuel economizer invented by Mitchell et al. is disclosed in U.S. Pat. No. 5,918,636. This fuel economizer device incorporates a Faraday housing and magnets of neodymium material mounted within the housing in a manner so as to concentrate the magnetic field produced. It is asserted in this patent that passing fuel through the magnetic force field will improve combustion efficiency of the fuel and minimize exhaust emissions.

In U.S. Pat. No. 5,048,501, Smith et al. teaches still another fuel economizer system for improving the octane rating performance of gasoline powered engines. An auxiliary system fractionalizes a precise portion of a required fuel and combines the fraction with a conventionally produced air/fuel mixture to optimize the combustion process.

Applicant has previously invented several versions of an ignition spark enhancing arrangement which utilizes a tightly wound length of metallic tubing, preferably copper tubing, into tightly spaced loops, the loops being generally coaxial one to another. The ends of the coiled portion of these devices are incorporated into, or form a complete spark plug lead wire to produce substantially more power, efficiency and smoothness of spark plug powered internal combustion engines. These prior patents of applicant are listed as follows:

U.S. Pat. No. 6,736,119
U.S. Pat. No. 6,796,298
U.S. Pat. No. 7,051,723
U.S. Pat. No. 7,168,406
U.S. Pat. No. 7,302,926

Applicant has also incorporated this tightly coiled looped tubing concept into a d.c. power enhancer for battery powered vehicles and internal combustion engines. This power enhancer is disclosed in U.S. Pat. No. 7,302,926.

The present disclosure teaches tightly coiled loops of tubing into a device which has now been found to, when affixed in close proximity to the flow of fuel to the engine, and energized by the engine electrical system, dramatically increase the fuel economy of an internal combustion engine. For example, when wrapped around a section of fuel line extending from a fuel tank to the engine, the preferred embodiment is connected, preferably, between a d.c. storage battery and the engine starter or alternator of the engine, system economy performance is significantly enhanced. Various other embodiments and aspects are also disclosed.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE DISCLOSURE

This disclosure is directed to an engine fuel economizer connected or connectable to establish an electrical path in conjunction with a d.c. battery and a starter motor or a charging alternator of an internal combustion engine. The device, in one aspect thereof includes a coil of conductive hollow tubing having a plurality of complete loops formed therealong, the device being preferably connected or connectable between a positive (+) terminal of the battery and a positive (+) alternator terminal or positive (+) contact of the starter motor. The coil of conductive hollow tubing, having a plurality of complete turns or loops, is positionable over and around a section of fuel line which extends from a fuel tank to the engine. In another aspect of this disclosure, the coil device is prepositioned preferably over and along a length of nonconductive tubing which is spliceable into the fuel line after a section of fuel line is sectioned and removed. Generally, a broad aspect is to place the fuel or a flowing portion thereof in close proximity with one of the various embodiments in electrical communication with the vehicle electrical system.

It is therefore an object of this disclosure to provide an engine fuel economizer which substantially improves the economy of an engine.

Still another object of this disclosure is to provide an engine fuel economizer which is positionable around a section of fuel line which extends from a fuel tank of a vehicle to the internal combustion engine therefor to produce enhanced fuel economy in operation of the vehicle.

Yet another object of this disclosure is to provide in one embodiment an engine fuel economizer device which is preconstructed and ready for installation to replace a section of a fuel line extending from a fuel tank to an internal combustion engine of a vehicle.

A broad object of this disclosure is to provide various embodiments which, when in electrical communication with the vehicle electrical system and in close proximity to the fuel in the vehicle, or a flowing portion thereof, substantially enhances the operating efficiency of the engine of the vehicle and thereby improves fuel economy.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE DISCLOSURE

Figure 1:
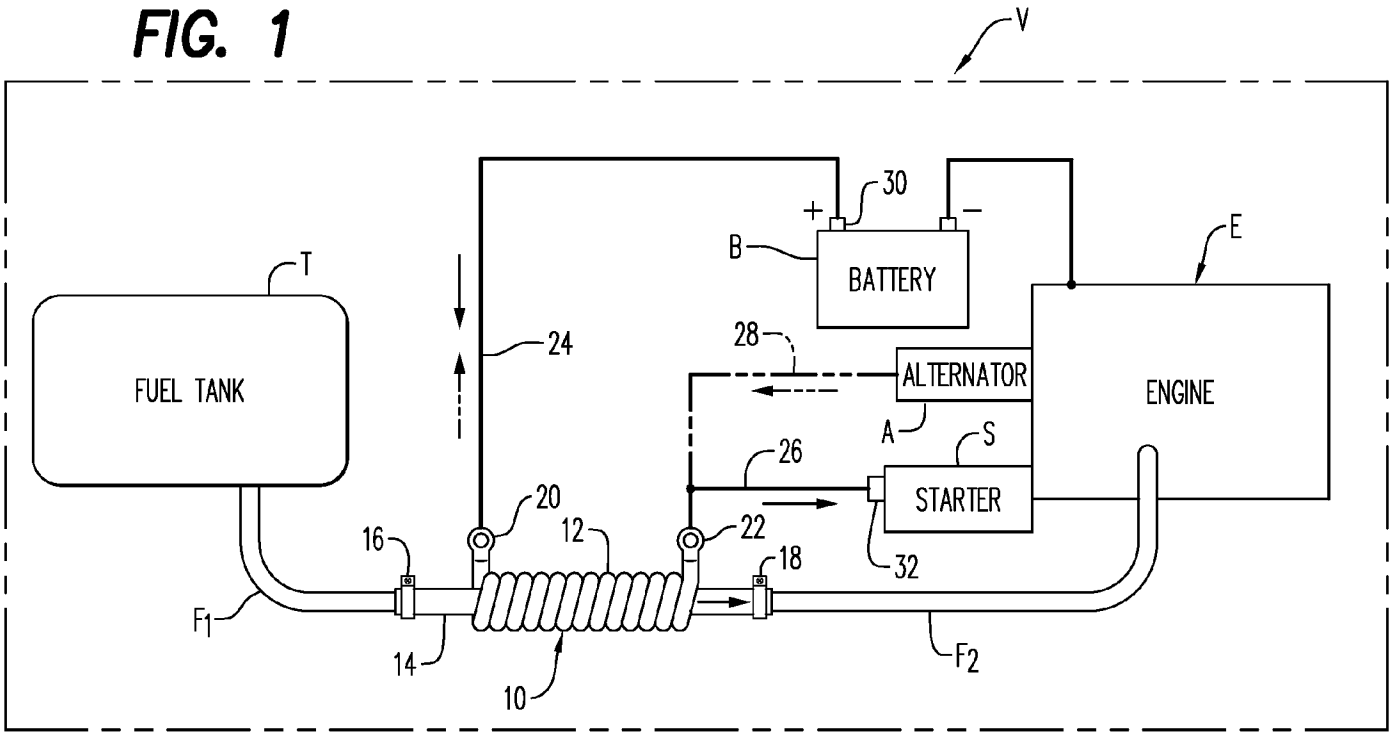
FIG. 1 is a simplified schematic view of one embodiment of the disclosure installed around a section of fuel line which extends from a fuel tank to an internal combustion engine.

Referring now to the drawings, and firstly to FIG. 1, a vehicle shown generally at V is typically equipped with an internal combustion engine E supplied with fuel from a fuel tank T, the two interconnected by a fuel line F1/F2. The vehicle V is also equipped with a d.c. voltage storage battery B which provides power to the engine E and its starter S along with other vehicle electronic and electrical systems and features (not shown). The engine E also includes an alternator A which charges the battery B when required and also produces d.c. voltage and current to the vehicle accessories. Moreover, the battery B provides power for the starter S to start the engine E.

Figure 2:
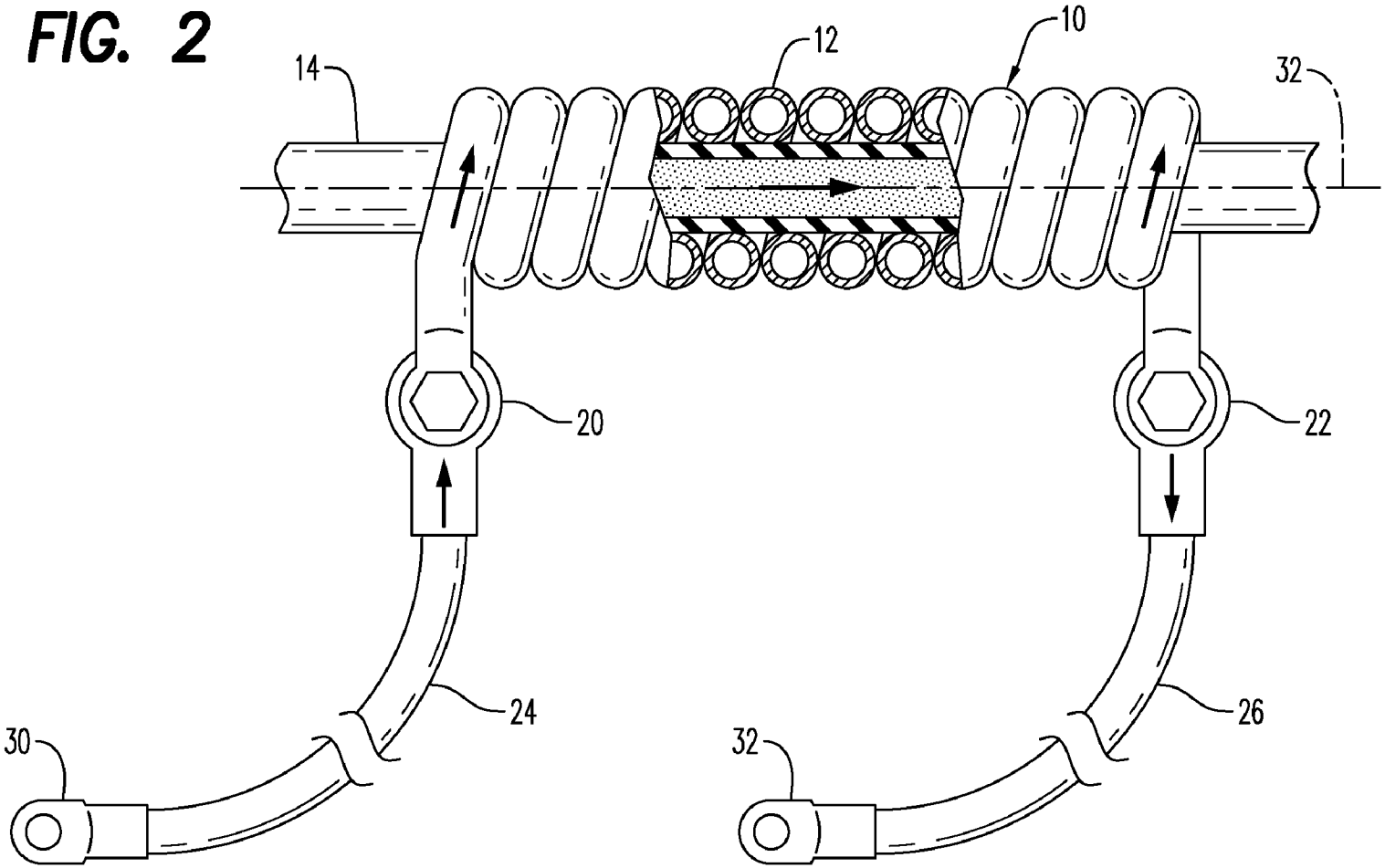
FIG. 2 is a an enlarged broken view of the disclosure shown in FIG. 1.

The fuel economizer or coiled device 10, also shown in detail in FIG. 2, is formed preferably of a length of copper tubing of ¼" o.d., ⅛" i.d. The conductive tubing 12 is coiled and formed into a plurality of tightly spaced and wound coaxial turns or loops so as to define a generally cylindrical passageway therethrough having a longitudinal axis 32 and being sized to snugly receive a length of non-metallic elastomeric fuel hose 14 positioned coaxially therethrough. The fuel hose 14 is sized to be connectable over and to replace a length of the vehicle fuel line between F1 and F2. Hose clamps 16 and 18 secure and seal each end of the fuel hose 14 around the corresponding cut ends of the fuel line sections F1 and F2.

One end 20 of the coiled device 10 is connected by an electrical conduit 24 to the positive terminal of the battery B at connector 30. The other end 22 of the coiled device 10 is connected by an electrical conduit 26 to the positive terminal of the starter S by connector 32. When so connected, activating the engine starter S will draw current from the battery B which will flow through the coiled device 10 in the direction of the solid arrows to the starter S. The solid arrows thus indicate that current is passing from the battery B into the starter S and through the coiled device 10 in series fashion thus energizing the device 10 and fuel flowing through the fuel line F1/F2 and fuel hose 14. Note, however, that other electrical arrangements between the various embodiments of the device and these vehicle electrical components are within the scope of this disclosure.

Once the engine E has been started by the starter S, the alternator A will then produce current to recharge the battery B. Under this condition, current will flow in the direction of the arrow in phantom from the alternator A into the battery B through electrical conduit 28, the coiled device 10 and electrical conduit 24. Again, the series-flowing current from the alternator A through the coiled device 10 will energize the fuel passing through the fuel hose 14 in a beneficial manner. Test measurements confirm a d.c. voltage potential between battery terminal 30 and the starter terminal 32 equal to the charging voltage output of the alternator A.

Figure 1A:
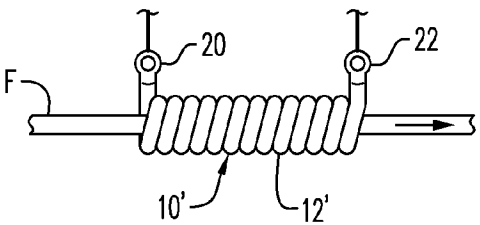
FIG. 1A is an alternate embodiment of the disclosure shown in FIG. 1.

As shown in FIG. 1A, an alternate embodiment of the disclosure is also in the form of the coiled device 10' structured as previously described. However, in this embodiment 10', each of the loops of the length of tubular conduit 12' is slightly smaller although still coaxial one to another so as to snugly fit over the fuel line F without having to cut the fuel line. An electrical insulating layer between the coil device 12' and the fuel line F may also be provided. Obviously, this embodiment 10' is preferably utilized in an OEM situation where the device 10 may be installed over the fuel line F at vehicle assembly.

Figure 3:
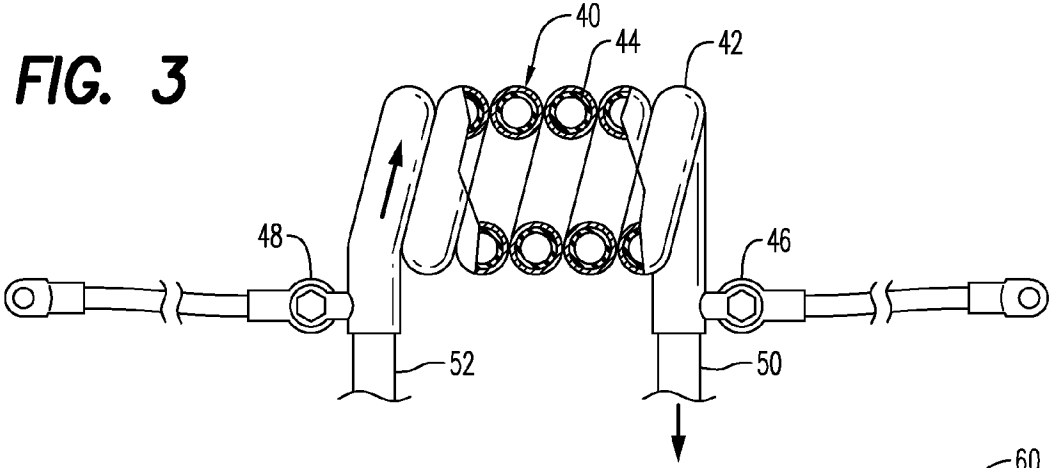
FIG. 3 is a broken section view of a coaxial embodiment of the disclosure.

Referring now to FIG. 3, still another embodiment of the invention is there shown generally at numeral 40 includes a tightly coiled length of conductive tubing 42 within which a preferably non-metallic coiled length of fuel line 44 is disposed co-extensively with the tubing 42. The inlet end 52 of the fuel line 44 is arranged to receive fuel from the fuel tank flowing in the direction of the arrow, the fuel exiting the coiled fuel line 44 through fuel line portion 50 in the direction of that arrow. The respective inside diameters of the fuel line 44 and the coiled device 40 are in the range of ⅛" to ½", depending on the fuel flow needs of the engine in the vehicle. Note in this embodiment 40 that a total of six coaxial tightly wound coils are provided, the coil diameter being in the range of 1" to 5" as determined empirically by economy performance of the vehicle and fuel line. Note that, although in this embodiment 40, the conductive coil conduit is formed to be on the outside of the fuel line 44, the reverse is also envisioned within the scope of this invention. One end 46 of the coiled device 42 is connected to one aspect of the vehicle electrical system, while the other end 48 is connected to a compatible corresponding component of the vehicle electrical system to energize the metallic coil 42, and thus the fuel flowing through the fuel line 44 while the engine is operating.

Figure 4:
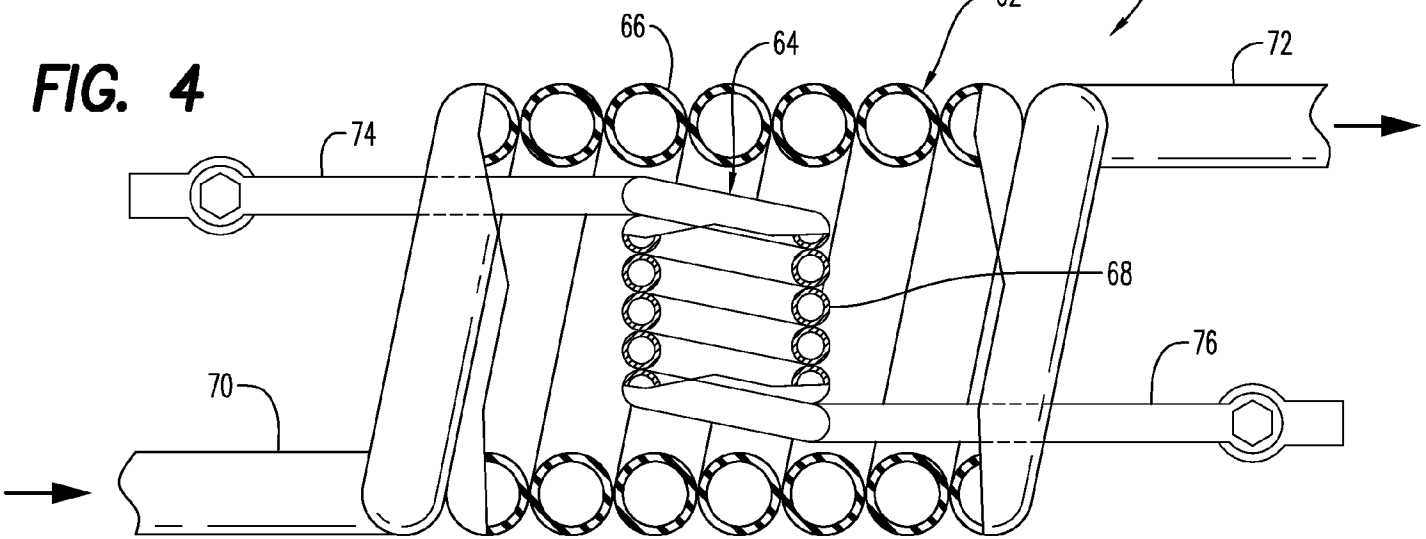
FIG. 4 is a broken section view of still another embodiment of the disclosure wherein the coils of the device and the coiled portion of a fuel line are oriented orthogonally one to another.

Referring now to FIG. 4, another unique aspect of this disclosure is there shown generally at numeral 60 and includes a coiled device 64 having a plurality of tightly spaced turns 68 formed of a length of conductive tubing. Each end thereof at 74 and 76 is interconnected to selected components of the vehicle electrical power system as previously described.

In this embodiment 60, the fuel line 62 preferably formed of non-conductive formable tubing or hose material, also is formed of a plurality of tightly spaced turns having an inlet portion 70 and an outlet portion 72. Importantly, in this embodiment 60, the longitudinal axis of the conductive coils of the device 64 is oriented orthogonally to the longitudinal axis of the coils of the fuel line 62 in a preferably non-contact arrangement. Nonetheless, the close proximity between the coiled device 64 and the coiled fuel line 62 is sufficient for the coiled device 64 to impart economizing energy into the fuel flowing through the coiled fuel line 62 in the direction of the arrows.

Figure 5:
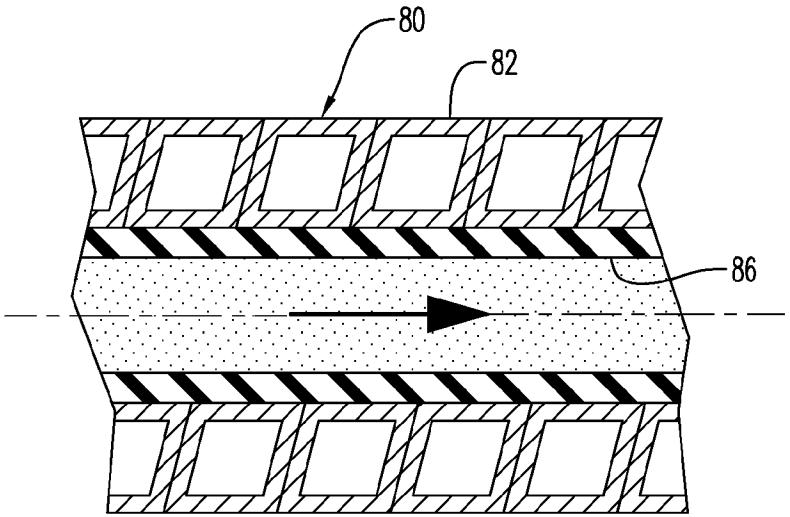
FIG. 5 is a partial section view of yet another embodiment of the disclosure.

Referring now to FIG. 5, a small section of another embodiment of the invention is there shown generally at numeral 80 and includes a conventional elastomeric fuel line 86, fuel flowing therethrough in the direction of the arrow. The coiled device 82 is formed of tightly spaced coils of square sectioned conductive tubing, preferably being copper, and having a coil inside diameter which snugly fits over the outside diameter of the fuel line 86.

Figure 6:
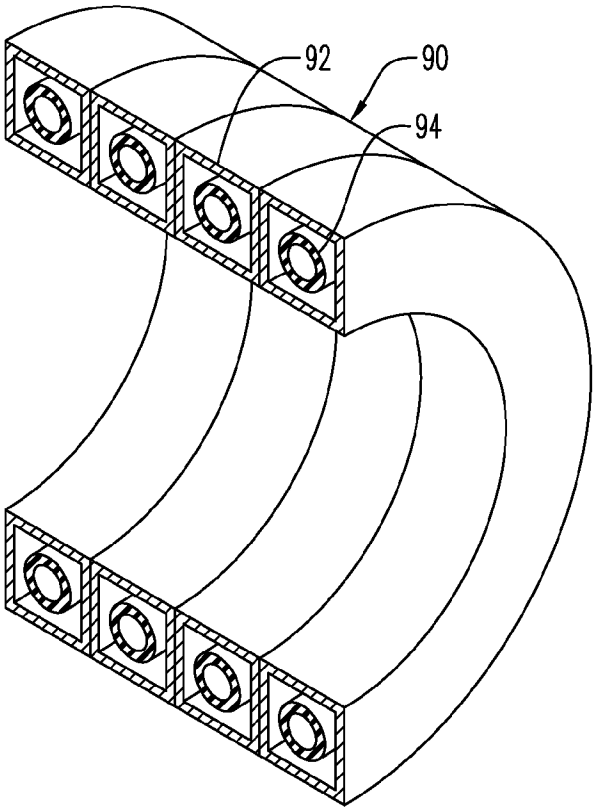
FIGS. 6, 7 and 8 are perspective views of three additional embodiments of the disclosure.

Referring now to FIG. 6, still another embodiment of the invention is there shown generally at numeral 90 wherein the conductive coiled device 92 is formed of tightly coiled square cross-sectional tubing, while the fuel line 94 formed of non-conductive material such as an elastomer, is fitted to be coextensive within the coiled device 92 as shown.

Figure 8:
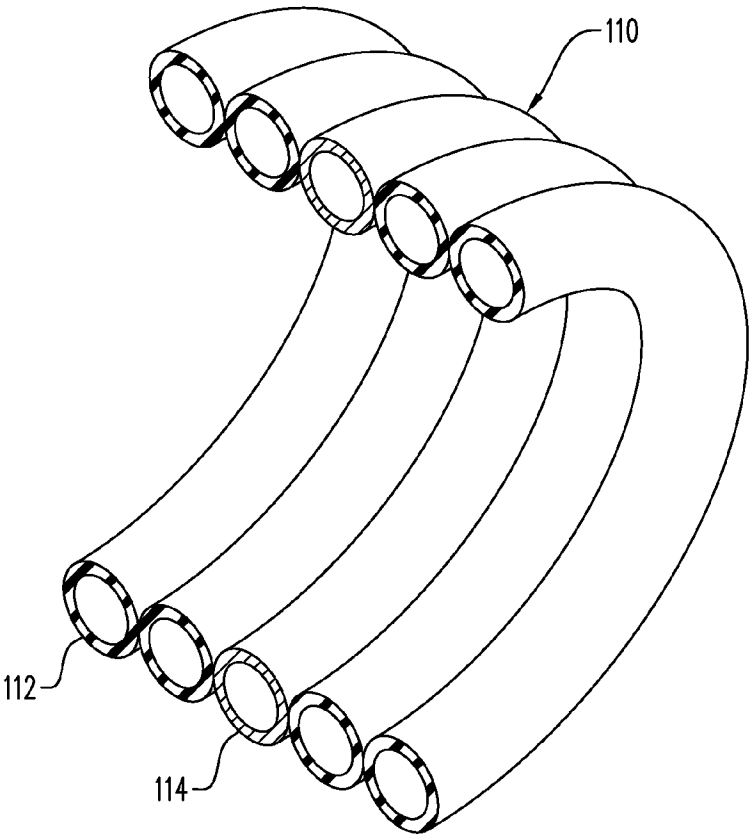
Figure 7:
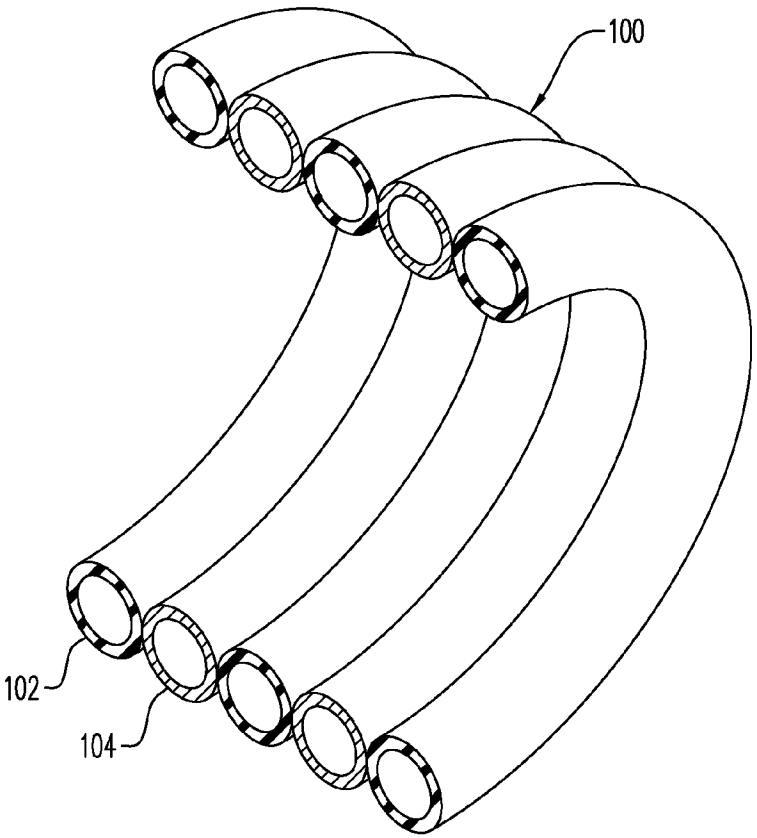

Referring now to FIG. 7, yet another embodiment of the invention is there shown generally at numeral 100 and includes tightly coiled conductive turns 104 of the device 100 and alternately coiled non-conductive fuel line 102. In FIG. 8, a similar device is there shown at 110 wherein the ratio of coils of the conductive coiled device 114 versus the alternating coils 112 of the fuel line are in a ration of 2:1. However, alternate ratios favoring the conductive coils of the device versus the coiled fuel lines are within the scope of this aspect of the invention.

Figure 9:
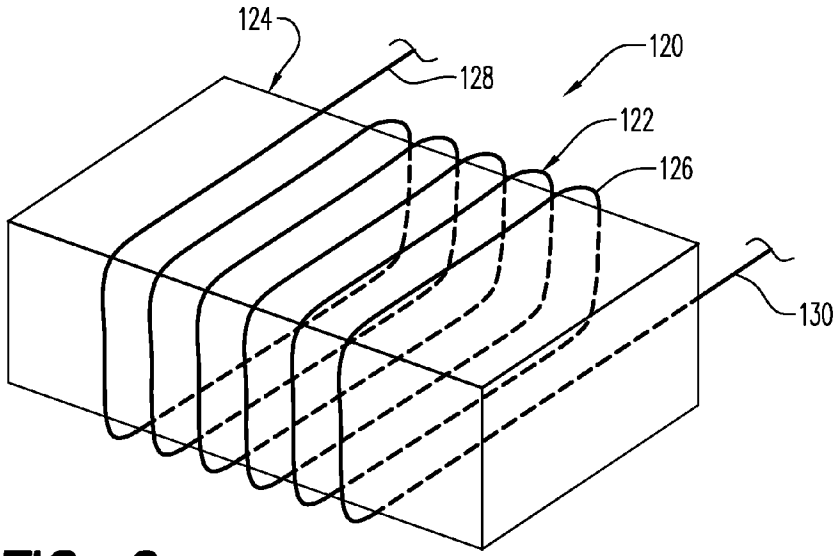
FIG. 9 is a perspective view of yet another embodiment of the disclosure in conjunction with a fuel tank of a vehicle.

Referring now to FIG. 9, it is envisioned that, in this embodiment shown generally at numeral 120, a fuel tank shown at 124 may be wrapped therearound by an embodiment 122 which includes tightly spaced rectangular turns 126, each end 128 and 130 of this coiled device 122 being interconnected with the appropriate components of the vehicle electrical system as previously described. By this arrangement, all of the fuel within the tank is envisioned to be energized for enhanced vehicle fuel economy before being conveyed to the engine.

Figure 10:
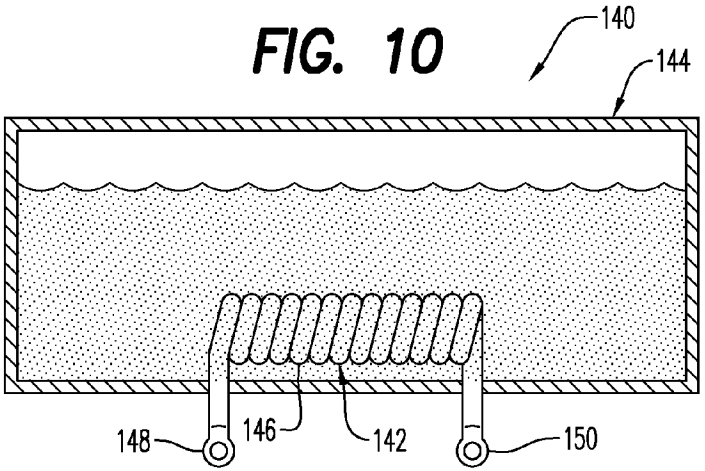
FIG. 10 is a section view showing yet another embodiment of the disclosure disposed directly within the fuel tank of the vehicle.

Referring lastly to FIG. 10, a conductive coiled device 142 formed to be similar to that shown in FIG. 2 is immersed within the fuel in a fuel tank 144 of this embodiment 140. The tightly wound turns 146 are sized as previously described made of preferably ¼" od metallic tubing and interconnected at 148 and 150 to appropriate electrical power delivery components of the vehicle. In this embodiment 140, as with respect to embodiment 120 shown in FIG. 9, appropriate safety features which ensure fuel ignition avoidance, although not shown here, must be incorporated into the overall design for safety purposes.

TEST EXAMPLE 1

The disclosure as shown in FIGS. 1 and 2 was installed into a 1999 Chevrolet 4×4 vehicle powered by a V6 engine. Drivability of the vehicle improved by displaying more available power, a smoother running engine, colder air conditioning, substantially improved radio clarity and improved braking.

A test-drive over 121.4 miles showed a fuel consumption with the device installed of 5.1 gallons of gasoline. This produced a net average mileage of 23.8 mpg. Comparatively, when the vehicle was new, the average mileage was approximately 15 to 16 mpg.

TEST EXAMPLE 2

The disclosure shown in FIGS. 1 and 2 was also installed on a 2004 Nissan Frontier pickup truck powered by a four-cylinder engine. This vehicle was used daily for mail delivery over substantially the identical route each day. Subjectively, after installation of the disclosure, this vehicle also exhibited more power, a smoother running engine, air conditioning which ran colder, cleaner smelling air passing through the vehicle, substantial improved clarity of radio reception, improved stopping and enhanced electrical system performance. This vehicle was test-driven a total of 250.3 miles during which time 10.5 gallons of gasoline were utilized. This produced an average mileage of 23.8 mpg. Moreover, this test vehicle prior to installation of the disclosure therein, typically consistently ran approximately 3.5 days between fuel fill up requirements. With the device installed, the vehicle ran approximately 4 to 5 days on each tankful of fuel.

TEST EXAMPLE 3

Utilizing the embodiment 60 shown in FIG. 4, a 1967 Mustang Fastbag GT having a 289 cu. in. V8 engine, a HOLLEY 750 csm carb, Hooker headers, a 3-speed C4 automatic transmission, and a 3.0 rear axle gear ratio was tested. Instrumentation used included a Garmin 1300 GPS for speed verification and distance, a Flowscan CE-12V flowmeter and totalizer, a PassPort G-meter and performance computer model GT-1 were used to document relative performance with and without the device 60 installed. Tests were run in both directions at 70 mph on the exact same route during each test leg. Without the device 60 installed in this vehicle, the economy at 70 mph was 17.5 mpg.

After the addition of the device 60 into the fuel system as described, the fuel economy was measured to be 19.2 mpg, again under the exact same environmental conditions, speed and vehicle directions. This represents and increase in fuel economy of approximately 1.7 mpg or an astounding 10% improvement over the above vehicle when not equipped with the device 60.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. An engine fuel economizer device comprising:

a single coil of hollow conductive tubing having a plurality of closely wound loops, the ends of said coil being configured for connection, or connected to, an engine starter and an alternator of an electrical power and charging system of the engine;

said coil being affixed in close proximity to the flow of fuel from a fuel tank to the engine;

electrical current passing from a battery of the system into the engine starter and through the coil in series before the engine starts, current flowing from the alternator of the system through the coil when the engine has been started.

2. An engine fuel economizer device as set forth in claim 1, wherein:

said coil sized for close positioning around a length of fuel line which carries fuel from a fuel tank to the engine, said coil being substantially coaxial with the length of fuel line.

3. An engine fuel economizer device as set forth in claim 1, further comprising:

a length of nonconductive fuel line sized in diameter to replace a section of a fuel line carrying fuel from the fuel tank to the engine.

4. An engine fuel economizer device as set forth in claim 3, wherein:

said hollow tubing is rectangular in cross-section.

5. An engine fuel economizer device as set forth in claim 1, further comprising:

a coiled length of fuel line carrying fuel and being formed having a plurality of closely wound loops.

6. An engine fuel economizer device as set forth in claim 5, wherein:

a longitudinal axis of said coil of conductive tubing is oriented generally orthogonally to a longitudinal axis of said coiled length of fuel line.

7. An engine fuel economizer device as set forth in claim 6, wherein:

said coil of conductive tubing is positioned within said coiled length of fuel line.

8. An engine fuel economizer device as set forth in claim 5, wherein:

a longitudinal axis of said coil conductive tubing is coaxial with a longitudinal axis of said coiled length of fuel line;

said coil of conductive tubing and said coiled length of fuel line having the same coil diameter with alternating coils of fuel line and conductive tubing.

9. An engine fuel economizer device as set forth in claim 1, wherein:

said conductive tubing is rectangular in cross-section.

10. An engine fuel economizer device as set forth in claim 1, wherein:

said coil is sized to fit in close proximity around a portion of a fuel tank.

11. An engine fuel economizer device as set forth in claim 1, wherein:

said coil is immersed in fuel within the fuel tank.

12. An engine fuel economizer device comprising:

a coil of hollow conductive tubing having a plurality of closely wound loops, the ends of said coil being configured for operable connection, or operably connected to, an engine starter and an alternator of an electrical power and charging system of the engine;

said coil being affixed in close proximity to the flow of fuel from a fuel tank to the engine;

electrical current passing from a battery of the system into the engine starter and through the coil in series before the engine starts, current flowing from the alternator of the system through the coil when the engine has been started.

13. An engine fuel economizer device consisting of:

a coil of hollow conductive tubing having a plurality of closely wound loops, the ends of said coil being configured for connection, or connected to, an engine starter and an alternator of an electrical power and charging system of the engine;

said coil being affixed in close proximity to the flow of fuel from a fuel tank to the engine;

electrical current passing from a battery of the system into the engine starter and through the coil in series before the engine starts, current flowing from the alternator of the system through the coil when the engine has been started.

* * * * *